US009057556B2

(12) United States Patent
Ashrafzadeh et al.

(10) Patent No.: US 9,057,556 B2
(45) Date of Patent: Jun. 16, 2015

(54) SELECT FILL SENSOR SYSTEM FOR REFRIGERATOR DISPENSERS

(75) Inventors: Farhad Ashrafzadeh, Stevensville, MI (US); Kevin M. Chase, Saint Joseph, MI (US); Brian P. Janke, Saint Joseph, MI (US); Shreecharan Kanchanavally, Lisle, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 950 days.

(21) Appl. No.: 12/718,174

(22) Filed: Mar. 5, 2010

(65) Prior Publication Data

US 2010/0155415 A1 Jun. 24, 2010

Related U.S. Application Data

(63) Continuation-in-part of application No. 12/017,118, filed on Jan. 21, 2008.

(51) Int. Cl.

| | |
|---|---|
| ***B67D 7/30*** | (2010.01) |
| ***F25D 23/12*** | (2006.01) |
| ***B67D 1/00*** | (2006.01) |
| ***B67D 1/08*** | (2006.01) |
| ***B67D 1/12*** | (2006.01) |
| ***F25C 5/00*** | (2006.01) |
| ***F25D 29/00*** | (2006.01) |

(52) U.S. Cl.

CPC ..... *F25D 23/126* (2013.01); *B67D 7/302* (2013.01); *B67D 7/30* (2013.01); *B67D 1/001* (2013.01); *B67D 1/0888* (2013.01); *B67D 1/1238* (2013.01); *F25C 5/005* (2013.01); *F25D 29/00* (2013.01); *F25D 2400/06* (2013.01); *F25D 2400/361* (2013.01)

(58) Field of Classification Search

CPC ..... B67D 7/30; B67D 7/302
USPC ..... 141/1, 95, 141, 198, 351, 360; 62/126, 62/177, 389, 449; 222/1, 52; 700/283
See application file for complete search history.

(56) References Cited

U.S. PATENT DOCUMENTS

| | | | |
|---|---|---|---|
| 3,823,846 | A | 7/1974 | Probst |
| 3,937,362 | A | 2/1976 | Salmijak et al. |
| 4,202,387 | A | 5/1980 | Upton |
| 4,437,497 | A | 3/1984 | Enander |
| 4,440,200 | A | 4/1984 | DeVale et al. |

(Continued)

FOREIGN PATENT DOCUMENTS

| | | | |
|---|---|---|---|
| JP | 7067892 | A | 3/1995 |

OTHER PUBLICATIONS

EP11157197 European Search Report dated Jan. 17, 2013.

*Primary Examiner* — Ryan Reis

(57) ABSTRACT

A refrigerator includes a dispenser having a dispenser well, a control for regulating a product dispensing operation, and a select fill sensor system for automatically initiating and terminating the dispensing operation. An optical sensing system includes a camera within the dispenser well in communication with a controller for sensing the fill rate of a container within the dispenser well. The dispensing rate of product is adjusted depending on the product fill rate of the container such that optimum fill rates are obtained without overflow or spilling events. In this manner, a hands-free dispenser is provided that can be utilized regardless of the shape or size of container utilized.

20 Claims, 5 Drawing Sheets

(56) References Cited

U.S. PATENT DOCUMENTS

| | | | | |
|---|---|---|---|---|
| 4,446,896 | A | 5/1984 | Campagna | |
| 4,458,735 | A | 7/1984 | Houman | |
| 4,572,253 | A | 2/1986 | Farmer et al. | |
| 4,733,381 | A | 3/1988 | Farmer et al. | |
| 4,780,861 | A | 10/1988 | Stembridge et al. | |
| 4,798,232 | A | 1/1989 | Stembridge et al. | |
| 4,883,100 | A | 11/1989 | Stembridge et al. | |
| 4,890,651 | A | 1/1990 | Stembridge et al. | |
| 4,917,155 | A | 4/1990 | Koblasz et al. | |
| 4,944,335 | A | 7/1990 | Stembridge et al. | |
| 4,961,456 | A | 10/1990 | Stembridge et al. | |
| 5,017,909 | A | 5/1991 | Goekler | |
| 5,036,892 | A | 8/1991 | Stembridge et al. | |
| 5,129,548 | A | 7/1992 | Wisniewski | |
| 5,490,547 | A | 2/1996 | Abadi et al. | |
| 5,491,333 | A * | 2/1996 | Skell et al. | 250/222.1 |
| 5,551,598 | A | 9/1996 | Cutsinger | |
| 5,819,547 | A | 10/1998 | Oh | |
| 5,862,844 | A * | 1/1999 | Perrin | 141/351 |
| 5,902,998 | A | 5/1999 | Olson et al. | |
| 6,082,419 | A | 7/2000 | Skell et al. | |
| 6,100,518 | A | 8/2000 | Miller | |
| 6,227,265 | B1 | 5/2001 | Skell et al. | |
| 6,394,153 | B2 * | 5/2002 | Skell et al. | 141/351 |
| 6,473,190 | B1 | 10/2002 | Dosmann | |
| 6,681,585 | B1 | 1/2004 | Stagg et al. | |
| 6,688,134 | B2 | 2/2004 | Barton et al. | |
| 6,705,356 | B2 | 3/2004 | Barton et al. | |
| 6,789,585 | B1 * | 9/2004 | Janke | 141/198 |
| 6,912,870 | B2 | 7/2005 | Gnadinger | |
| 7,028,725 | B2 | 4/2006 | Hooker | |
| 7,109,512 | B2 | 9/2006 | Wirthlin | |
| 7,201,005 | B2 | 4/2007 | Voglewede et al. | |
| 7,210,601 | B2 | 5/2007 | Hortin et | |
| 7,353,850 | B2 | 4/2008 | Greiwe et al. | |
| 7,690,403 | B2 * | 4/2010 | You et al. | 141/83 |
| 8,245,735 | B2 | 8/2012 | Chase et al. | |
| 8,327,889 | B2 | 12/2012 | Ashrafzadeh et al. | |
| 2005/0268624 | A1 | 12/2005 | Voglewede et al. | |
| 2005/0268639 | A1 | 12/2005 | Hortin et al. | |
| 2006/0196212 | A1 | 9/2006 | Jenkins, Jr. et al. | |
| 2008/0023659 | A1 | 1/2008 | Dietz et al. | |
| 2008/0083475 | A1 | 4/2008 | Lamb | |

* cited by examiner

SELECT FILL SENSOR SYSTEM FOR REFRIGERATOR DISPENSERS

CROSS-REFERENCE TO RELATED APPLICATIONS

This application represents a continuation-in-part of U.S. patent application Ser. No. 12/017,118, filed Jan. 21, 2008, pending.

BACKGROUND OF THE INVENTION

1. Field of the Invention

The present invention pertains to the art of refrigerators and, more particularly, to a sensor system employed in a dispenser mounted in a refrigerator door.

2. Description of the Related Art

Refrigerators having built-in ice/water dispensers are well known in the art. In general, the dispensers are mounted to a door of the refrigerator for the purpose of dispensing ice and/or water without requiring a user to access a refrigerator compartment. A typical dispenser includes a dispenser well into which a container is placed. Once the container is in position, an actuator is operated to release the ice and/or water into the container.

In many cases, the actuator is a pressure sensitive mechanical switch. Typically, the switch is operated by pushing the container against, for example, a lever. The lever, in turn, operates the switch that causes the ice and/or water to be dispensed. A number of dispensers employ multiple actuators, one for ice and another for water, while other dispensers employ a single actuator. Dispensers which employ a single actuator typically require additional control elements that enable a user to select between ice and water dispensing operations. Several manufacturers have converted from mechanical switches to electrical or membrane switches. Functioning in a similar manner, a container is pushed against the membrane switch to initiate the dispensing operation. Still other arrangements employ actuator buttons provided on a control panel of the dispenser. With this arrangement, the user continuously depresses a button to release ice and/or water into the container. In yet another arrangement, sensors are mounted in the dispenser well and function to sense a presence and size of the container. The dispenser automatically begins dispensing ice or water based on the presence of the container and stops dispensing before the container overfills. In this case, the level of liquid or ice dispensed is dependent on the container, and cannot be altered by a consumer based on the amount of liquid or ice desired.

Over time, mechanical and membrane switches wear out. Physical interaction with the switches results in wear and tear on contact points, springs, levers and the like, which eventually require replacement. Another drawback with existing systems is the lack of an automatic cut-off feature. More specifically, once activated, the dispenser will discharge water or ice until the pressure is removed from the actuator. If the user is momentarily distracted or if the dispenser is operated by an inexperienced individual such as a child, the level of ice or water can overflow the container.

There also exist drawbacks with the systems that employ automatic actuators. Most active sensors cannot differentiate between a container and a child's hand. Thus, in such systems, the mere act of a child inserting a hand or other object into the dispenser well will initiate a dispensing operation. In addition, active sensors require both the sending and receiving of signals. Sensors of this type may require periodic alignment and necessitate the use of multiple components which further add to the overall cost and complexity of the appliance.

Therefore, despite the existence of refrigerator dispensers in the prior art, there still exists a need for an enhanced refrigerator dispensing system. More specifically, there exists a need for a refrigerator dispensing system that can be utilized regardless of the shape or size of the container to be filled, and that allows for a hands-free dispensing event.

SUMMARY OF THE INVENTION

The present invention is directed to a refrigerator including a cabinet within which is defined at least one refrigerated compartment. A door is pivotally mounted to the cabinet to provide access to the refrigerated compartment. A dispenser assembly is provided in the door to enable users to obtain ice and/or water without requiring access to the refrigerated compartment. The dispenser includes a main body portion, a control portion including a plurality of control elements for selecting a desired dispensing operation, a dispenser well provided in the main body portion, and a sensor system.

In accordance with the invention, an optical sensing system is provided including a camera located within a dispenser well of the dispenser assembly in communication with a controller for regulating the dispensing assembly. Initially, the optical sensing system may be utilized to detect the presence of a container within the dispenser well. Alternatively, another sensor, such as an ultrasonic sensor, can be utilized to detect the presence of the container. After the presence of the container is detected and a desired product level is selected, the controller initiates a product dispensing event, and product is dispensed into the container until the product level within the container reaches the corresponding selected product level. The optical sensing system monitors the fill rate of the container and adjusts the product dispensing rate so that the fill rate is optimized, while avoiding overflow or spill events.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
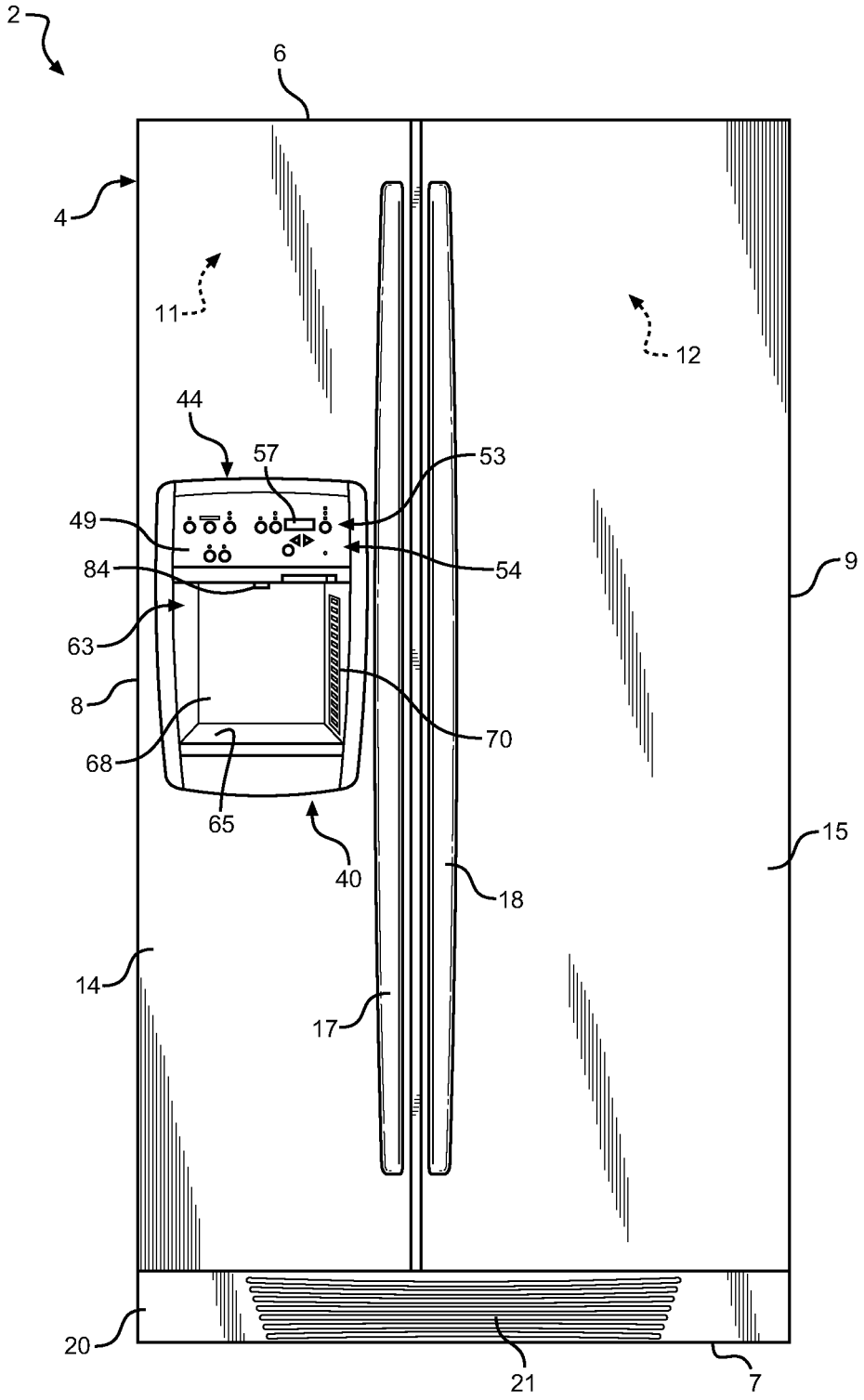
FIG. 1 is a front elevational view of a refrigerator incorporating a dispenser having a sensor system constructed in accordance with one embodiment of the present invention.

With initial reference to FIG. 1, a refrigerator constructed in accordance with the present invention is generally indicated at 2. Refrigerator 2 includes a cabinet 4 having a top wall 6, a bottom 7 and opposing side walls 8 and 9. In a manner known in the art, refrigerator 2 includes a freezer compartment 11 arranged along side a fresh food compartment 12. Freezer compartment 11 includes a corresponding freezer compartment door 14 and fresh food compartment 12 includes a corresponding fresh food compartment door 15. In a manner also known in the art, each door 14 and 15 includes an associated handle 17 and 18. Refrigerator 2 is also shown to include a kick plate 20 arranged at a bottom portion thereof having a vent 21 that permits air to flow to refrigeration components (not shown) that establish and maintain desired temperatures in freezer compartment 11 and fresh food compartment 12. In the embodiment shown, refrigerator 2 constitutes a side-by-side model. However, it should be understood that the present invention could also be employed in connection with a wide variety of refrigerators, including top mount, bottom mount, and French-style refrigerator models.

In accordance with the invention, refrigerator 2 includes a dispenser assembly 40 having a main housing 44 and a control panel 49. Control panel 49 includes first and second rows of control buttons 53 and 54 which enable a user to select various program parameters and operations. Control panel 49 further includes a display 57 which, in addition to functioning in cooperation with dispenser assembly 40, enables the user to select particular operational parameters for refrigerator 2, such as desired temperatures for freezer compartment 11 and fresh food compartment 12. Additionally, dispenser assembly 40 includes a dispenser well 63 having a base or container support portion 65 and a recessed, upstanding wall section 68.

Figure 2:
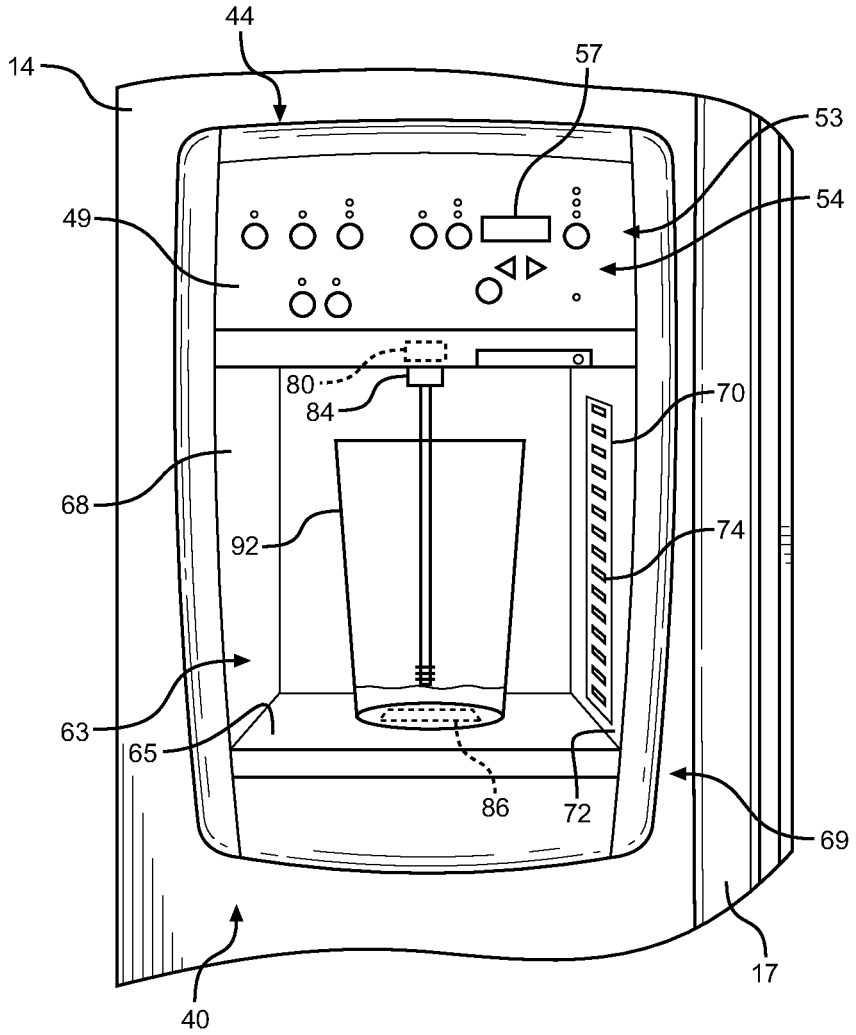
FIG. 2 is an enlarged view of the dispenser of FIG. 1 illustrating the beginning of a dispensing operation in accordance with the present invention.

Turning to FIG. 2, in accordance with one embodiment of the invention, dispenser assembly 40 includes a select fill sensor system of the present invention, which is generally indicated at 69, includes a means for selecting a product fill level, i.e., a touch sensor 70, preferably located on a side wall portion 72 of dispenser well 63, and a means for indicating the fill level, i.e., a feedback array 74. In the embodiment shown, feedback array 74 is in the form of a light emitting diode (LED) array extending vertically along side wall portion 72, although other feedback arrangements may be utilized, including a liquid crystal display (LCD) screen. Preferably, feedback array 74 extends substantially the entire height of upstanding wall section 68 so as to provide the optimal amount of fill level choices. Touch sensor 70 is preferably a capacitive-type sensor adapted to sense the touch of a user. However, it is also contemplated that electric field (E-field), inductive, infrared (IR), resistive, interactive LCD, membrane or push button sensors may be utilized. Regardless of the particular sensor, touch sensor 70 is utilized to select a desired level of a product (i.e., liquid or ice) dispensed within a container 76, as will be discussed in more detail below.

Figure 3:
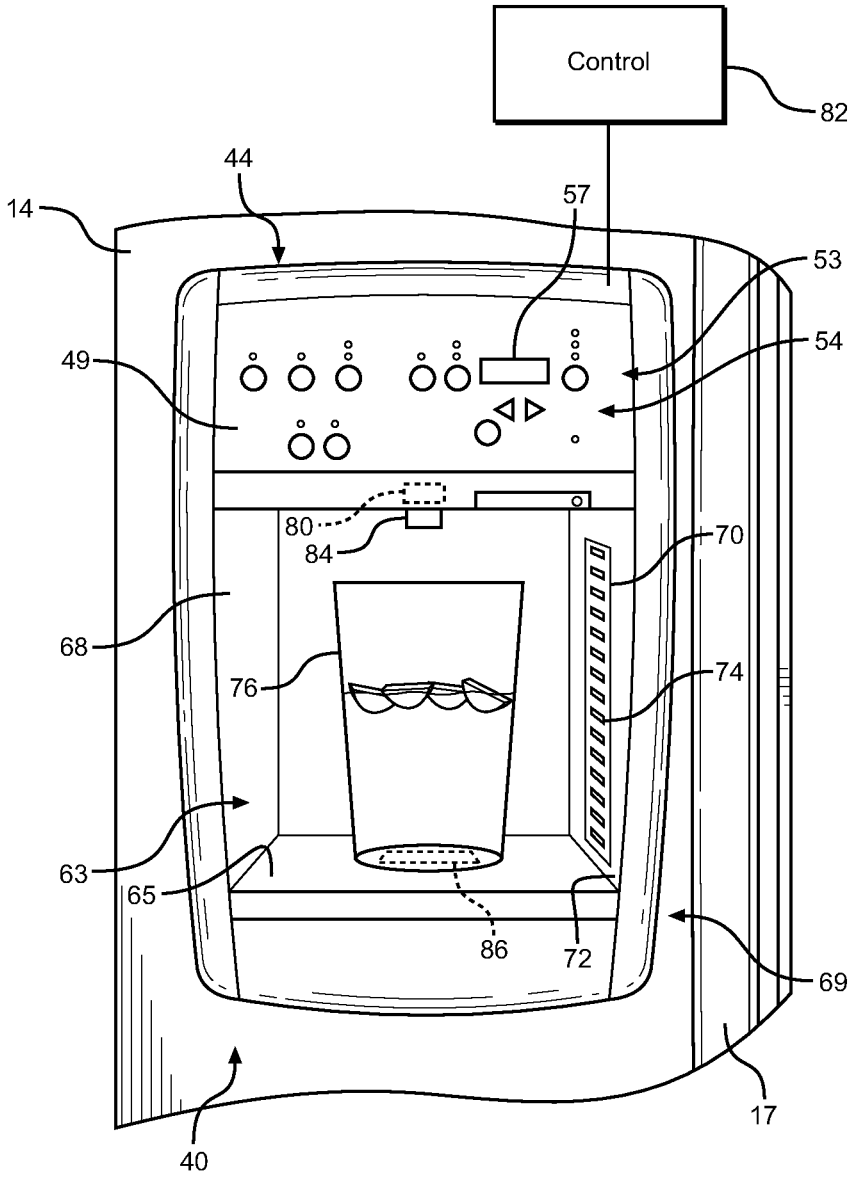
FIG. 3 is an enlarged view of the dispenser of FIG. 1 illustrating the end of a dispensing operation in accordance with the present invention.

In accordance with one embodiment of the present invention, sensor system 69 further comprises a means for sensing the level of ice and/or water within container 76, i.e., a product level sensor indicated at 80 in FIGS. 2 and 3. In one embodiment, product level sensor 80 constitutes a top-mounted ultrasonic sensor adapted to continuously sense the level of water and/or ice within container 76. In accordance with the preferred embodiment, product level sensor 80 comprises an image-mapping (camera) system. Alternatively, product level sensor 80 comprises a capacitive, IR or pressure/weight sensor arrangement. Sensor system 69 also includes a container recognition device adapted to sense the presence of container 76 within dispenser well 63. In accordance with one embodiment, the container recognition device comprises a weight or pressure sensor 86, but the container recognition device could be constituted by an ultrasonic sensor positioned at the side or behind container 76, an IR sensor positioned at the side of container 76, a retro-reflective IR sensor positioned at the top, side or back of container 76, a side or back capacitive sensor, or an E-field sensor. In the preferred embodiment of the present invention, the container recognition device is constituted by a camera sensing system, or optical sensing system. In an alternative embodiment, ultrasonic product level sensor 80 also functions to sense the presence of container 76 within dispenser well 63 such that a separate container recognition sensor 86 is not needed. Regardless, unlike prior art technologies, which require sensing the height of a container, the present invention need only sense the presence of container 76 and may be utilized with containers having a variety of sizes and shapes.

In use, container recognition device 86 detects the presence of container 76 and feedback array 74 is illuminated, thereby prompting a user to select a desired product fill level. A consumer then makes a product fill level selection by touching touch sensor 70 at a height level corresponding with the desired fill level for container 76. The particular LED(s) associated with the selected fill level will remain illuminated, while the remaining LEDs will dim or be extinguished. In accordance with the most preferred form of the invention, control 82 automatically initiates a dispensing operation after container 76 is sensed and upon receipt of the product fill level selection. Control 82 will continue the dispensing of water from a spout 84 and/or ice through a chute (not shown) until product level sensor 80 detects that the fill level has reached the selected product level, at which point the dispensing operation is automatically terminated. In one preferred embodiment of the invention, feedback array 74 tracks the product level within container 76. More specifically, as the product level in container 76 rises, the LEDs within feedback array 74 are illuminated to track the progress of the fill event as depicted in FIGS. 2 and 3.

Based on the above description, it should be readily apparent that dispenser assembly 40 of the present invention advantageously provides a hands-free method of filling a container with water and/or ice to a desired level, regardless of the particular size or shape of the container utilized and without the need for a user to calculate the volume of water and/or ice desired.

Although shown on the same side wall portion of the dispenser assembly, the feedback array and touch sensor may be located on different portions of the dispenser assembly. In addition, sensor system 69 may include overflow prevention, such as in the form of a software algorithm that utilizes the rate of water level change sensed by the product level sensor to determine when water and/or ice has begun to spill over the side of a container. Upon sensing an overflow event, sensor system 69 will automatically terminate the dispensing operation. Furthermore, it should be realized that the invention can be employed in connection with dispensing various liquid, e.g., water or flavored beverages, and ice, e.g., cubed, crushed or shaved, products.

Figure 4:
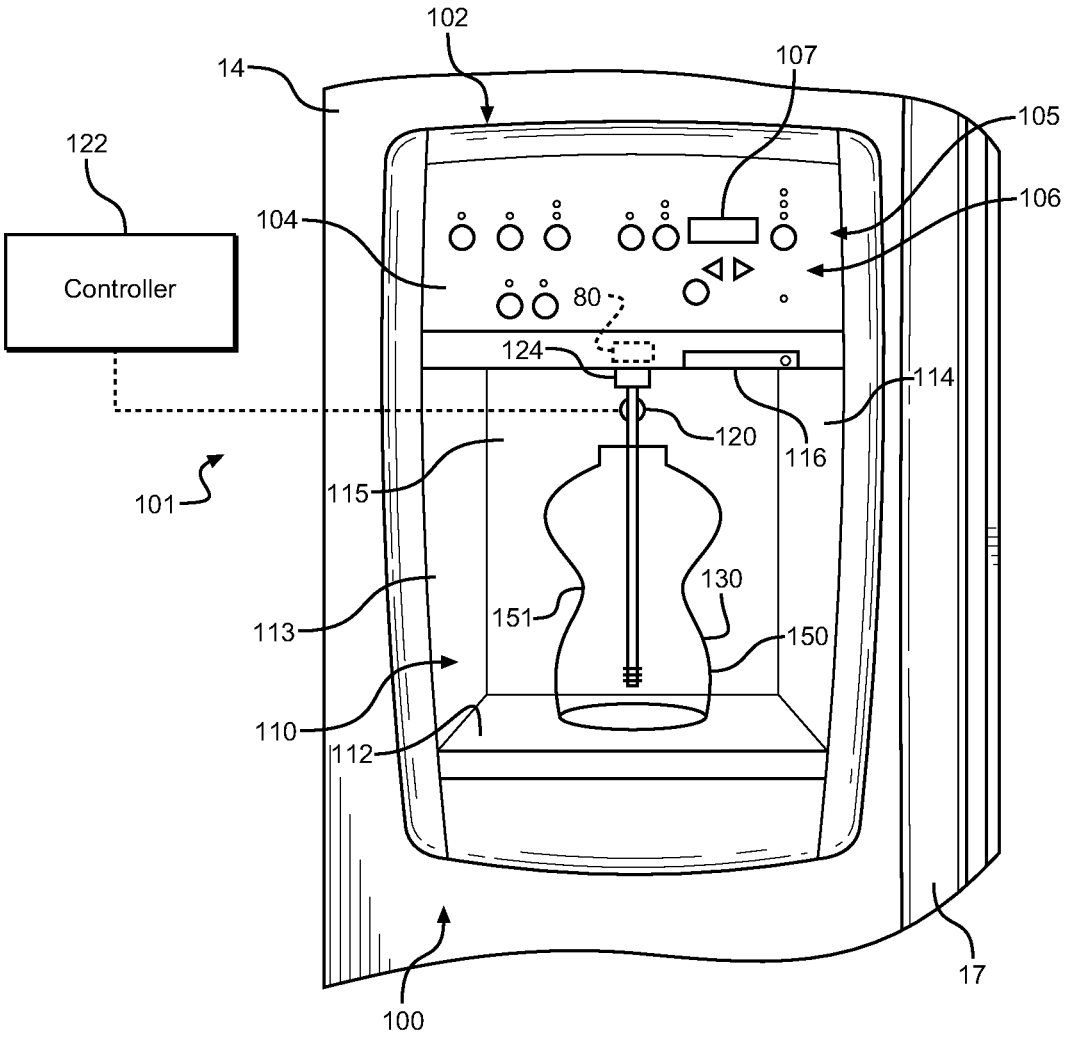
FIG. 4 is an enlarged view of a dispenser including an optical sensing system in accordance with a preferred embodiment of the present invention.

As noted above, either or both of the container recognition device and the product level sensor 80 may comprise an image-mapping camera system. To this end, FIG. 4 depicts an alternative dispenser assembly 100 including an optical sensing system 101 in accordance with another preferred embodiment of the present invention. Similar to the dispenser assembly 40 depicted in FIG. 2, dispenser assembly 100 includes a main housing 102 and a control panel 104. Control panel 104 includes first and second rows of control buttons 105 and 106 which enable a user to select various program parameters and operations. Control panel 104 further includes a display 107 which, in addition to functioning in cooperation with dispenser assembly 100, enables a user to select particular operational parameters for refrigerator 2, such as desired temperatures for freezer compartment 11 and fresh food compartment 12. Additionally, dispenser assembly 100 includes a dispenser well 110 having a base or container support portion 112, recessed, upstanding wall opposing side wall sections 113 and 114, a back wall 115 and a top wall 116. A camera 120 is located within dispenser well 110. Camera 120 is in communication with a controller 122, which regulates the dispensing of water from a spout 124 or ice from a chute (not shown) into a container 130, as will be discussed in more detail below. Although depicted on upstanding wall section 115, it should be understood that camera 120 may be located anywhere exposed to dispenser well 110, so long as camera 120 is positioned to monitor the presence of container 130, as well as the height of liquid or ice within container 130.

The manner in which optical sensing system 101 is utilized will now be discussed with reference to FIGS. 4 and 5. In use, image data from camera 120 is transmitted to controller 122 for image processing. In one embodiment of the present invention, after sensing the presence of container 130 within dispenser well 110, camera 120 is utilized as a dispensing sensor to monitor the height of liquid or ice within container 130 as it is dispensed in real-time. More specifically, a video processing algorithm is utilized by controller 122 in conjunction with real-time image data in the form of video image data from camera 120 to determine the status of a fill event, as well as to determine the alignment of container 130 with spout 124 or the ice chute (not shown), as well as the shape of container 130. In an alternative embodiment, dispensing sensor 80, as described with reference to the first embodiment, in the form of an ultrasonic sensor or other equivalent sensor, is utilized to determine the status of a fill event. In this alternative embodiment, an image processing algorithm is utilized by controller 122, rather than the video image processing algorithm, to determine the alignment of container 130 and the shape of container 130.

Figure 5:
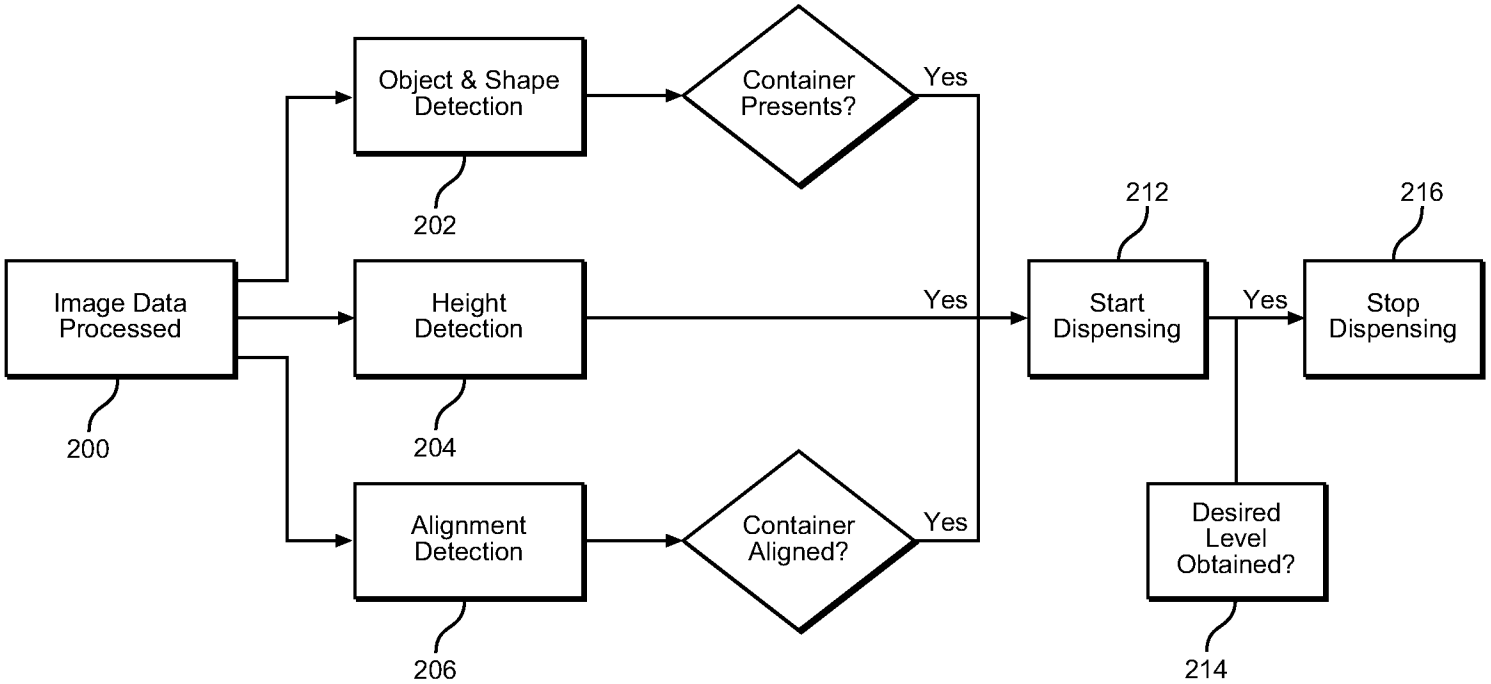
FIG. 5 is a flow chart depicting a method of utilizing the optical sensing system of FIG. 4.

Initially, image data from camera 120 is transmitted to and processed by controller 122, as indicated at 200 in FIG. 5. Shape recognition software within controller 122 determines the shape of an object within dispenser well 110, such as the shape of container 130, as depicted in step 202. In a preferred embodiment, controller 122 is able to distinguish between the presence of a container in dispenser well 110 and the presence of another object, such as a user hand. Additionally, image data from camera 120 is utilized by controller 122 to determine the height of an object, such as container 130, as indicated at 204, as well as alignment of an object, such as the opening of container 130, with spout 124 or the ice dispensing chute (not shown), as indicated at 206. Based on information transmitted from dispensing sensor 80, controller 122 determines whether a container is present within dispenser well 110 and is properly aligned to receive water or ice. If the container is present and properly aligned at steps 208 and 210, controller 122 allows for water or ice to be dispensed from dispenser assembly 100 at step 212 until a desired fluid or ice level is obtained step 214, at which point the controller 122 will terminate the dispensing event at step 216.

In addition to the above, camera 120 and controller 122 are advantageously employed to adjustably vary the speed or rate at which liquid and/or ice is dispensed into container 130 based on how quickly the liquid or ice level increases within container 130. More specifically, product is dispensed at a first faster dispensing rate when the container fill rate is below a predetermined rate, and at a second dispensing rate slower than the first dispensing rate when the container fill rate is faster than the predetermined rate. Thus, for a narrower container, fluid is dispensed slower as compared to fluid dispensed into a larger container, which fills up more slowly. In one embodiment, controller 122 adjusts the product dispensing rate continuously throughout a dispensing event. In this way, controller 122 is able to adjust the dispensing rate based on the fill rate of a shaped container, such as container 130, having portions with varying volumes. More specifically, with reference to FIG. 4, controller 122 senses a first slower fill rate when product is being dispensed into the first larger volume portion 150 of container 130, and communicates with dispenser 100 to dispense product at a first faster rate; and senses a faster fill rate when product is being dispensed into the second smaller volume portion 151, wherein controller 122 communicates with dispenser 100 to dispense product at a second slower rate. It should be understood that container 130 can have a plurality of varying volume portions such that controller 122 may adjust the product dispensing rate a plurality of times during a dispensing event. Thus, a hands-free dispensing system is provided which allows for optimal fill rates of a container, while avoiding overflow and spill events.

Notifications of various conditions may be communicated to a user through indicators (not shown) on control panel 104, or in the form of sounds, such as beeps or buzzes, etc. For example, control panel 104 may initiate a beep or other sound effect when a fill event is complete.

Although described with reference to preferred embodiments of the invention, it should be readily understood that various changes and/or modifications can be made to the invention without departing from the spirit thereof. For instance, while discussed in context with a refrigerator, it should be understood that the dispensing assembly of the present invention could be utilized separately from a domestic refrigerator. In general, the invention is only intended to be limited by the scope of the following claims.

What is claimed is:

1. A refrigerator comprising:
- a cabinet;
- at least one refrigerated compartment arranged within the cabinet;
- a door mounted to the cabinet for selectively providing access to the at least one refrigerated compartment; and
- a dispenser assembly for selectively releasing at least one of a liquid and ice into a container during a dispensing operation, said dispenser assembly including:
  - a dispenser well including a base section and an upstanding wall section;
  - a controller for regulating the dispensing operation of the dispenser assembly; and
  - an optical sensing system in communication with the controller, the optical sensing system including:
    - a camera exposed to the dispenser well and adapted to send image data from the dispenser well to the controller, wherein the controller varies a rate of product dispensing during the dispensing operation based on the image data.

2. The refrigerator according to claim 1, wherein the controller additionally detects a presence of a container in the dispenser well based on the image data.

3. The refrigerator according to claim 1, wherein the controller additionally detects a shape of a container within the dispenser well based on the image data.

4. The refrigerator according to claim 1, wherein the controller utilizes a video processing algorithm to process the image data and determine a height of the at least one of the liquid or ice within the container.

5. A dispenser assembly for selectively releasing at least one of a liquid and ice into a container during a dispensing operation, said dispenser assembly including:

a dispenser well including a base section and an upstanding wall section;

a controller for regulating the dispensing operation of the dispenser assembly; and an optical sensing system in communication with the controller, the optical sensing system including:

a camera exposed to the dispenser well and adapted to send image data from the dispenser well to the controller, wherein the controller varies a rate of product dispensing during the dispensing operation based on the image data.

6. The dispenser according to claim 5, wherein the controller additionally detects a presence of a container in the dispenser well based on the image data.

7. The dispenser according to claim 5, wherein the controller additionally detects a shape of a container within the dispenser well based on the image data.

8. The dispenser according to claim 5, wherein the controller utilizes a video processing algorithm to process the image data and determine a height of the at least one of the liquid or ice within the container.

9. A method of dispensing a product from a refrigerator dispenser assembly including a dispenser well, the method comprising:

transmitting image data from a camera exposed to the dispenser well to a controller;

determining the presence of a container within the dispenser well;

initiating a dispensing event to dispense product from the dispenser assembly subsequent to determining the presence of the container within the dispenser well;

monitoring a fill level of product within the container utilizing the image data; and varying a rate at which product is dispensed from the dispenser assembly during the dispensing event.

10. The method of claim 9, wherein varying the rate at which the product is dispensed includes dispensing the product at a first dispensing rate in a first stage of the dispensing event and at a second dispensing rate slower than the first dispensing rate in a second stage of the dispensing event.

11. The method of claim 10, further comprising: monitoring a fill rate of the product during the dispensing event, wherein the product is dispensed at the first dispensing rate when the container fill rate is below a predetermined fill rate, and the product is dispensed at the second dispensing rate when the container fill rate is faster than the predetermined fill rate.

12. The method of claim 11, wherein monitoring the fill rate of product comprises processing video image data from the camera.

13. The method of claim 9, wherein determining the presence of a container within the dispenser well comprises processing the image data to determine the presence of a container within the dispenser well.

14. The method of claim 9, further comprising: determining a shape of the container within the dispenser well using the image data, wherein the controller varies the rate at which product is dispensed from the dispenser assembly based on the shape of the container.

15. The method of claim 9, further comprising: determining an alignment of an opening of the container within the dispenser well using the image data, wherein the dispensing event is initiated upon determining both the presence of the container within the dispenser well and proper alignment of the container within the dispenser well.

16. The method of claim 9, further comprising: notifying a user when the dispensing event is complete.

17. The method of claim 9, wherein the product dispensing rate changes multiple times throughout the dispensing event.

18. The refrigerator of claim 1, wherein the a dispenser assembly further comprises:

a container recognition device in communication with the controller, the container recognition device being selected from the group consisting of a pressure sensor, an ultrasonic sensor, an infrared sensor, a retro-reflective infrared sensor, a capacitive sensor and an electric field sensor.

19. The dispenser of claim 5, further comprising:

a container recognition device in communication with the controller, the container recognition device being selected from the group consisting of a pressure sensor, an ultrasonic sensor, an infrared sensor, a retro-reflective infrared sensor, a capacitive sensor and an electric field sensor.

20. The method of claim 9, wherein the step of determining the presence of a container within the dispenser well is accomplished utilizing data from a, container recognition device in communication with the controller, the container recognition device being selected from the group consisting of a pressure sensor, an ultrasonic sensor, an infrared sensor, a retro-reflective infrared sensor, a capacitive sensor and an electric field sensor.

* * * * *